US009915885B2

(12) United States Patent
Katsumata et al.

(10) Patent No.: US 9,915,885 B2
(45) Date of Patent: Mar. 13, 2018

(54) TONER

(71) Applicant: CANON KABUSHIKI KAISHA, Tokyo (JP)

(72) Inventors: Wakiko Katsumata, Kashiwa (JP); Kentaro Kamae, Kashiwa (JP); Masaharu Miura, Toride (JP); Takeshi Ohtsu, Toride (JP); Koh Ishigami, Abiko (JP); Ryuichiro Matsuo, Moriya (JP); Yosuke Iwasaki, Abiko (JP); Yuichi Mizo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/144,381

(22) Filed: May 2, 2016

(65) Prior Publication Data

US 2016/0334725 A1 Nov. 17, 2016

(30) Foreign Application Priority Data

May 13, 2015 (JP) ..... 2015-098583
Apr. 20, 2016 (JP) ..... 2016-084737

(51) Int. Cl.
*G03G 9/00* (2006.01)
*G03G 9/087* (2006.01)

(52) U.S. Cl.
CPC ..... *G03G 9/08755* (2013.01); *G03G 9/08782* (2013.01); *G03G 9/08795* (2013.01); *G03G 9/08797* (2013.01)

(58) Field of Classification Search
CPC ..... G03G 9/08755; G03G 9/08797; G03G 9/08795; G03G 9/08782
See application file for complete search history.

(56) References Cited

U.S. PATENT DOCUMENTS 6,998,212 B2 2/2006 Shirai et al.
7,041,422 B2 * 5/2006 Shirai ..... C08G 63/20 430/109.3
7,279,262 B2 10/2007 Fujikawa et al.
7,288,348 B2 10/2007 Hayami et al.
7,306,887 B2 12/2007 Tanaka et al.
7,396,626 B2 7/2008 Fujikawa et al.
7,396,629 B2 7/2008 Baba et al.
7,611,813 B2 11/2009 Ida et al.
7,629,100 B2 12/2009 Okamoto et al.
7,767,370 B2 8/2010 Ishigami et al.
7,858,283 B2 12/2010 Ishigami et al.
7,927,775 B2 4/2011 Komatsu et al.
7,939,233 B2 5/2011 Inoue et al.
8,084,174 B2 12/2011 Hasegawa et al.
8,137,886 B2 3/2012 Baba et al.
8,298,742 B2 10/2012 Okamoto et al.
8,323,726 B2 12/2012 Naka et al.
8,758,968 B2 6/2014 Watanabe et al.
8,916,323 B2 12/2014 Sugama et al.
8,921,023 B2 12/2014 Baba et al.
8,927,188 B2 1/2015 Naka et al.
8,945,805 B2 2/2015 Baba et al.
8,974,994 B2 3/2015 Kamae et al.
8,986,914 B2 3/2015 Fujikawa et al.
9,034,551 B2 5/2015 Endo et al.
9,046,800 B2 6/2015 Hotta et al.
9,058,924 B2 6/2015 Komatsu et al.
9,063,443 B2 6/2015 Ishigami et al.
9,075,328 B2 7/2015 Minagawa et al.
9,152,088 B1 10/2015 Kobori et al.
9,417,540 B2 8/2016 Rodee et al.
9,447,229 B2 9/2016 Moiryama et al.
2003/0224278 A1 12/2003 Shirai et al.
2009/0233212 A1 7/2009 Fujikawa et al.
2010/0028796 A1 2/2010 Nakamura et al.
2010/0183971 A1 7/2010 Fujikawa et al.
2011/0236812 A1 * 9/2011 Ishihara ..... G03G 9/0819 430/105
2011/0262856 A1 * 10/2011 Sugimoto ..... G03G 9/0804 430/109.4
2012/0214097 A1 8/2012 Naka et al.
2013/0244159 A1 9/2013 Ishigami et al.
2013/0309603 A1 11/2013 Takahashi et al.
2014/0096409 A1 4/2014 Ohtsu et al.
2014/0101966 A1 4/2014 Minagawa et al.
(Continued)

FOREIGN PATENT DOCUMENTS

EP 2833211 A1 2/2015
EP 2896640 A1 7/2015
JP 2004-061875 A 2/2004
JP 2011-123352 A 6/2011
JP 2012-118499 A 6/2012
JP 2013-242523 A 12/2013
JP 2014-006339 A 1/2014
JP 2004-286842 A 10/2014
WO 2014042193 A1 3/2014

*Primary Examiner* — Thorl Chea
(74) *Attorney, Agent, or Firm* — Fitzpatrick Cella Harper and Scinto

(57) ABSTRACT

The present invention provides a toner that excels in low-temperature fixability and also maintains charging performance, storability, and anti-hot offset property even in long-term image output. The toner comprising a toner particle containing an amorphous polyester resin, a crystalline polyester resin, wax, and a colorant, wherein a weight-average molecular weight (Mw) of the crystalline polyester resin is 5000 to 14,000, and the crystalline polyester resin includes 0.5 mass % to 15.0 mass % of a segment derived from one or more aliphatic compounds selected from the group consisting of aliphatic monocarboxylic acids with a carbon number of 8 to 20 and aliphatic monohydric alcohols with a carbon number of 8 to 20.

4 Claims, No Drawings

(56) References Cited

U.S. PATENT DOCUMENTS

| | | | |
|---|---|---|---|
| 2014/0120468 | A1 | 5/2014 | Mizo et al. |
| 2014/0134535 | A1 | 5/2014 | Baba et al. |
| 2014/0137428 | A1 | 5/2014 | Takenaka et al. |
| 2014/0329176 | A1 | 11/2014 | Takenaka et al. |
| 2015/0086917 | A1 | 3/2015 | Iwasaki et al. |
| 2015/0177634 | A1 | 6/2015 | Kamae et al. |
| 2016/0109820 | A1 | 4/2016 | Hashimoto et al. |

* cited by examiner

TONER

BACKGROUND OF THE INVENTION

Field of the Invention

The present invention relates to a toner useful for an electrophotographic system, an electrostatic recording system, an electrostatic printing system, and a toner jet system.

Description of the Related Art

Following wide spread of full-color copiers of an electrophotographic system in recent years, a demand has grown for further improvement of image quality and reduction in energy consumption. In the electrophotographic system, a printed matter is generally obtained through a development step, transfer step, and fixing step.

From the standpoint of saving energy, it is desirable to develop a toner that can be melted more rapidly and at a lower temperature than the conventional toners, thereby enabling rapid fixing at a low energy in the fixing process which consumes a large amount of power for heating.

To meet such a requirement, it is necessary to soften the toner, but from the standpoint of heat-resistant storability and durability, such an objective cannot be attained simply by softening the binder resin of the toner particles which is contained in the toner.

Further, a problem associated with the diversification of electrophotographic printing in recent years is that when continuous printing is performed on paper types of various sizes, for example, when printing on A4 paper is performed immediately after printing on small-size paper such as postcards and envelopes, the temperature of the fixing member portion which is not in contact with the paper rises thereby causing a hot offset.

Accordingly, Japanese Patent Application Publications No. 2004-061875 and 2011-123352 have suggested toners with low-temperature fixability improved as a result of including a composite resin constituted by an amorphous resin and a crystalline polyester resin having a sharp melt property.

Where the content of the crystalline polyester resin is increased, the low-temperature fixability is further improved, but the resin strength and durability degrade. As a result, the anti-hot offset property and storability are lost due to thermal stresses and mechanical stresses. Further, since an external additive on the surface is freed or embedded due to the decrease in resin strength, the charging performance and flowability are degraded, and a problem of melt adhesion at parts such as a photosensitive member easily occurs during printing.

Another problem is that since charges leak through the crystalline polyester resin, the amount of charges on the toner is decreased and the image is distorted.

Meanwhile, methods of increasing compatibility of the crystalline polyester resin and amorphous resin have been suggested for improving the low-temperature fixability while reducing the content of the crystalline polyester resin.

For example,

Japanese Patent Application Publication No. 2012-118499 suggests reducing the molecular weight of the crystalline polyester resin;

Japanese Patent Application Publication No. 2004-286842 suggests including a lubricating agent; and Japanese Patent Application Publication No. 2013-242523 suggests adjusting the SP value of the resin.

In an example of Japanese Patent Application Publication No. 2012-118499, a crystalline polyester resin is described which has a molecular weight as low as 6100, but this is insufficient for realizing a high image quality which is presently required, while maintaining the low-temperature fixability of the toner.

Further, Japanese Patent Application Publication No. 2014-006339 suggests a toner in which the degree of crystallization is increased and both the low-temperature fixability and the charge stability are ensured by adding a nucleating agent to a crystalline polyester resin. In an example of Japanese Patent Application Publication No. 2014-006339, since the molecular weight of the crystalline polyester resin is as high as 17,000 or higher, compatibility with the amorphous polyester resin serving as a binder resin is insufficient, and the low-temperature fixability cannot be attained at a level which is presently required to further increase the operation speed and reduce energy consumption.

As mentioned hereinabove, in the field of toners having toner particles including a crystalline polyester resins, there is still room for investigation aimed at ensuring excellent low-temperature fixability and also charging performance, storability, and anti-hot offset property in combination with increase in speed and improvement in image quality.

SUMMARY OF THE INVENTION

The present invention provides a toner that resolves the above-mentioned problems. More specifically, the present invention provides a toner that excels in low-temperature fixability and also maintains charging performance, storability, and anti-hot offset property even in long-term image output.

The present invention provides a toner comprising a toner particle containing an amorphous polyester resin, a crystalline polyester resin, wax, and a colorant, wherein the crystalline polyester resin contains 0.5 mass % to 15.0 mass % of a segment derived from one or more aliphatic compounds selected from the group consisting of aliphatic monocarboxylic acids with a carbon number of 8 to 20 and aliphatic monohydric alcohols with a carbon number of 8 to 20.

In accordance with the present invention, it is possible to provide a toner that excels in low-temperature fixability and also maintains charging performance, storability, and anti-hot offset property even in long-term image output.

Further features of the present invention will become apparent from the following description of exemplary embodiments.

DESCRIPTION OF THE EMBODIMENTS

The toner in accordance with the present invention comprises a toner particle containing an amorphous polyester resin, a crystalline polyester resin, wax, and a colorant, wherein the crystalline polyester resin contains 0.5 mass % to 15.0 mass % of a segment derived from one or more aliphatic compounds selected from the group consisting of aliphatic monocarboxylic acids with a carbon number of 8 to 20 and aliphatic monohydric alcohols with a carbon number of 8 to 20.

The crystalline polyester resin which is used in accordance with the present invention has a comparatively small molecular weight and high compatibility with the amorphous polyester resin serving as a binder resin. Therefore, the crystalline polyester resin demonstrates a very strong effect as a softening agent.

Therefore, the low-temperature fixability can be greatly increased by adding the resin in an amount less than that required for various other crystalline polyester resins.

Generally, where the molecular weight of a crystalline polyester resin is decreased, the resin strength decreases and durability also decreases. As a result, charging performance and storability are easily degraded by thermal stresses and mechanical stresses. For this reason, image distortion during printing and melt adhesion of the toner to parts such as a photosensitive member can occur.

The comprehensive research conducted by the inventors has demonstrated that the above-mentioned problems can be resolved even when the molecular weight of a crystalline polyester resin is low, provided that the crystalline polyester resin includes a specific amount of a segment derived from one or more aliphatic compounds selected from the group consisting of:

aliphatic monocarboxylic acids with a carbon number of 8 to 20 and aliphatic monohydric alcohols with a carbon number of 8 to 20.

The inventors have analyzed a crystalline polyester resin in a toner particle of a toner in which the crystalline polyester resin includes the specific amount of the segment derived from the aliphatic compound and which is improved in charging performance and storability. The results demonstrated that the content ratio of a low-molecular weight component (component with a number average molecular weight of 1000 or less) is decreased. The following reason could thus be suggested for explaining why the abovementioned problem could be resolved.

The content of a low-molecular weight component derived from an unreacted monomer is generally larger in a crystalline polyester resin with a low molecular weight than in a crystalline polyester resin with a high molecular weight.

However, where the aliphatic compound is added in the process of synthesizing the crystalline polyester resin with a low molecular weight, this compound reacts with the ends of the molecular chain constituting the crystalline polyester resin and acts as end caps, thereby preventing the molecular chain from extending.

Therefore, when the crystalline polyester resin with the required molecular weight is synthesized, apparently practically the entire unreacted free monomer is reacted. As a result, the amount of the low-molecular weight component derived from the unreacted monomer is reduced and a structure with a sharp molecular weight distribution can be realized. This is supposedly why the storability, durability, and charging performance are greatly improved.

In the present invention, the crystalline polyester resin includes 0.5 mass % to 15.0 mass % of a segment derived from one or more aliphatic compounds selected from the group consisting of aliphatic monocarboxylic acids with a carbon number of 8 to 20 and aliphatic monohydric alcohols with a carbon number of 8 to 20.

When the carbon number of the aliphatic monocarboxylic acid is less than 8, or when the carbon number of the aliphatic monohydric alcohol is less than 8, the storability is degraded.

Meanwhile, where the carbon number of the aliphatic monocarboxylic acid is 21 or more, or when the carbon number of the aliphatic monohydric alcohol is 21 or more, the compatibility of the crystalline polyester resin and amorphous polyester resin is degraded. Therefore, the low-temperature fixability is degraded.

The carbon number of the aliphatic monocarboxylic acid is preferably from 8 to 18.

The carbon number of the aliphatic monohydric alcohol is preferably from 8 to 18.

When the content of the segment derived from the aliphatic compound is less than 0.5 mass %, the storability and charging performance are degraded. Meanwhile, where the content exceeds 15.0 mass %, the low-temperature fixability is degraded.

The content of the segment derived from the aliphatic compound is preferably 3.0 mass % to 12.0 mass %.

The comprehensive research conducted by the inventors revealed that there is a correlation between the amount of charge and the time constant of rise when the charging performance of a toner is evaluated.

It was also found that since there is a correlation between the charge amount and the work function, there is a correlation between the time constant of rise and the work function.

In other words, where the energy of ultraviolet radiation falling on a measurement sample is plotted against the abscissa, and the square root of the number of photoelectrons emitted due to this energy is plotted against the ordinate, the charging performance improves with the increase in the value of work function representing the energy at which the emission of the photoelectrons is started.

Further, the inventors have found that when a low-molecular weight component derived from an unreacted monomer is contained in a large amount in a crystalline polyester resin, the value of the work function thereof decreases and the charging performance is degraded.

The preferred configuration of the toner in accordance with the present invention is explained hereinbelow in detail.

<Crystalline Polyester Resin>

The toner particle contained in the toner in accordance with the present invention includes a crystalline polyester resin.

The crystalline polyester resin shows a clear melting point peak in differential scanning calorimetric measurements using a differential scanning calorimeter (DSC).

In the present invention, the crystalline polyester resin is a polycondensate of an alcohol component including at least one compound selected from the group consisting of aliphatic diols with a carbon number of 2 to 22 and derivatives thereof, and a carboxylic acid component including at least one compound selected from the group consisting of aliphatic dicarboxylic acids with a carbon number of 2 to 22 and derivatives thereof.

Among them, a resin which is a polycondensate of an alcohol component including at least one compound selected from the group consisting of aliphatic diols with a carbon number of 6 to 12 and derivatives thereof, and a carboxylic acid component including at least one compound selected from the group consisting of aliphatic dicarboxylic acids with a carbon number of 6 to 12 and derivatives thereof.

is preferred from the standpoint of low-temperature fixability and storability.

The reason why the low-temperature fixability of the toner having the toner particle including the crystalline polyester resin is improved in the present invention is considered hereinbelow.

Thus, this is because the amorphous polyester resin serving as a binder resin and the crystalline polyester resin are compatible, the spacing of the molecular chain of the amorphous polyester resin is increased and the intermolecular forces are weakened, which results in a state with a greatly increased glass transition temperature (Tg) of the toner (toner particle) and a low melt viscosity.

In other words, as the compatibility of the amorphous polyester resin and crystalline polyester resin is increased, the low-temperature fixability tends to improve.

In order to improve the compatibility of the amorphous polyester resin and crystalline polyester resin, it is possible to reduce the carbon number of the aliphatic diol and/or aliphatic dicarboxylic acid constituting the crystalline polyester resin, increase the concentration of ester groups, and increase polarity.

However, the storability in use or transportation under a high-temperature high-humidity environment needs to be ensured even in toners with a greatly reduced glass transition temperature (Tg). Therefore, where a toner is exposed to such an environment, the crystalline polyester resin in the compatibilized toner needs to be recrystallized and the glass transition temperature (Tg) of the toner needs to be returned to the vicinity of the glass transition temperature (Tg) of the crystalline polyester resin.

Accordingly, where the ester group concentration in the crystalline polyester resin is high and the compatibility of the amorphous polyester resin and crystalline polyester resin is also too high, it is difficult to recrystallize the crystalline polyester resin and the storability of the toner tends to degrade.

It follows from the above, that from the standpoint of both the low-temperature fixability and the storability, it is preferred that the carbon number of the aliphatic diol constituting the crystalline polyester resin be from 6 to 12 and the carbon number of the aliphatic dicarboxylic acid be from 6 to 12.

The aliphatic diol with a carbon number of 2 to 22 (preferably 6 to 12) is not particularly limited, but is preferably a chain (preferably linear) aliphatic diol. Examples thereof include ethylene glycol, diethylene glycol, triethylene glycol, 1,2-propanediol, dipropylene glycol, 1,3-propanediol, 1,4-butanediol, 1,4-butadiene glycol, 1,5-pentanediol, neopentyl glycol, 1,6-hexanediol, 1,7-heptanediol, 1,8-octanediol, 1,9-nonanediol, 1,10-decanediol, 1,11-undecanediol, and 1,12-dodecanediol.

Among them, linear aliphatic α, ω-diols such as 1,6-hexanediol, 1,7-heptanediol, 1,8-octanediol, 1,9-nonanediol, 1,10-decanediol, 1,11-undecanediol, and 1,12-dodecanediol are preferred.

The derivatives in the present invention are not particularly limited, provided that a similar resin structure can be obtained by the condensation polymerization. For example, derivatives obtained by esterification of the abovementioned diols can be used. In the present invention, the at least one compound selected from the group consisting of aliphatic diols with a carbon number of 2 to 22 (preferably, 6 to 12) and derivatives thereof in the alcohol component constituting the crystalline polyester resin takes preferably 50 mass % or more, more preferably 70 mass % or more of the entire alcohol component.

In the present invention, a polyhydric alcohol other than the abovementioned aliphatic diol can be also used.

Examples of diols, other than the abovementioned aliphatic diol, among the polyhydric alcohols include aromatic alcohols such as polyoxyethylenated bisphenol A and polyoxypropylenated bisphenol A; and 1,4-cyclohexanedimethanol.

Examples of trihydric and higher polyhydric alcohols among the aforementioned polyhydric alcohols include aromatic alcohols such as 1,3,5-trihydroxymethylbenzene; and aliphatic alcohols such as pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, and trimethylolpropane.

Meanwhile, the aliphatic dicarboxylic acid with a carbon number of 2 to 22 (preferably, 6 to 12) is not particularly limited and may be a chain (preferably linear) aliphatic dicarboxylic acid.

Examples of suitable acids include oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, and itaconic acid.

The derivatives in the present invention are not particularly limited, provided that a similar resin structure can be obtained by the condensation polymerization. Suitable examples include acid anhydrides of the dicarboxylic acid component and derivatives obtained by methyl esterification, ethyl esterification, and acid chloridation of the dicarboxylic acid component. In the present invention, the at least one compound selected from the group consisting of aliphatic dicarboxylic acids with a carbon number of 2 to 22 (preferably, 6 to 12) and derivatives thereof in the carboxylic acid compound constituting the crystalline polyester resin takes preferably 50 mass % or more, more preferably 70 mass % or more of the entire carboxylic acid component.

In the present invention, a polyvalent carboxylic acid other than the abovementioned aliphatic dicarboxylic acid can be also used.

Among the polyvalent carboxylic acids, examples of divalent carboxylic acids other than the abovementioned aliphatic dicarboxylic acids include aromatic carboxylic acids such as isophthalic acid and terephthalic acid; aliphatic carboxylic acids such as n-dodecylsuccinic acid and n-dodecenylsuccinic acid; and alicyclic carboxylic acids such as cyclohexanedicarboxylic acid. Anhydrides or lower alkyl esters of those acids can be also used.

Among other polyvalent carboxylic acids, examples of trivalent and higher polyvalent acids include aromatic carboxylic acids such as 1,2,4-benzene tricarboxylic acid (trimellitic acid), 2,5,7-naphthalene tricarboxylic acid, 1,2,4-naphthalene tricarboxylic acid, and pyromellitic acid, and aliphatic carboxylic acids, such as 1,2,4-butane tricarboxylic acid, 1,2,5-hexane tricarboxylic acid, and 1,3-dicarboxyl-2-methyl-2-methylenecarboxypropane. Derivatives such as anhydrides or lower alkyl esters of those acids can be also used.

In the present invention, the crystalline polyester resin is a resin in which one or more aliphatic compounds selected from the group consisting of aliphatic monocarboxylic acids with a carbon number of 8 to 20 and aliphatic monohydric alcohols with a carbon number of 8 to 20 are bonded by condensation to an end of the crystalline polyester resin.

More specifically, where a carboxyl group is present at the end of the crystalline polyester resin before an aliphatic compound is bonded thereto, a condensation reaction with a monohydric alcohol is induced and a bond is generated.

Further, where a hydroxyl group is present at the end of the crystalline polyester resin before an aliphatic compound is bonded thereto, a condensation reaction with a monocarboxylic acid is induced and a bond is generated.

Therefore, the "segment derived from one or more aliphatic compounds" in the present invention means a structure in which OH has been taken from the carboxyl group of the aliphatic monocarboxylic acid and a structure in which H has been taken from the hydroxyl group of the aliphatic monohydric alcohol.

The "end" as referred to herein is also inclusive of the end of a branched chain when the crystalline polyester resin has the branched chain.

Where the carbon number of the aliphatic compound is within the abovementioned range, condensation is easily induced at the end of the polyester molecular chain, and the aliphatic compound is not present anymore as a free monomer. Therefore, this range is preferred from the standpoint of storability.

Examples of the aliphatic monocarboxylic acid with a carbon number 8 to 20 are presented below.

Caprylic acid (octanoic acid), pelargonic acid (nonanoic acid), capric acid (decanoic acid), undecyl acid, lauric acid (dodecanoic acid), tridecyl acid, myristyl acid (tetradecanoic acid), pentadecylic acid, palmitic acid (hexadecanoic acid), margaric acid (heptadecanoic acid), stearic acid (octadecanoic acid), nonadecyl acid, and arachidic acid (icosanoic acid).

Examples of the aliphatic monohydric alcohols with a carbon number 8 to 20 are presented below.

1-Octanol (capryl alcohol), 1-nonanol (pelargonic alcohol), decyl alcohol (decanol), undecanol, lauryl alcohol (dodecanol), tridecanol, myristyl alcohol (tetradecanol), pentadecanol, palmityl alcohol (hexadecanol), heptadecanol, stearyl alcohol (octadecanol), nonadecanol, and arachidyl alcohol (icosanol).

The following analysis is performed to determine whether or not the aliphatic compound has bonded to the crystalline polyester resin.

A sample solution is prepared by weighing 2 mg of a sample and dissolving the sample by adding 2 mL of chloroform. A crystalline polyester resin or a toner comprising a toner particle including a crystalline polyester resin is used as a resin sample.

Then, a matrix solution is prepared by weighing 20 mg of 2,5-dihydroxybenzoic acid (DHBA) and dissolving the acid by adding 1 mL of chloroform.

Further, an ionization aid solution is prepared by weighing 3 mg of Na trifluoroacetate (NaTFA) and then dissolving by adding 1 mL of acetone.

A measurement sample is obtained by mixing 25 μL of the sample solution, 50 μL of the matrix solution, and 5 μL of the ionization aid solution, which were prepared in the above-described manner, dropping the mixture on a sample plate for MALDI analysis, and drying.

A mass spectrum is obtained by using MALDI-TOFMS (Reflex III, manufactured by Bruker Daltonics).

Attribution of each peak in the oligomer region (m/Z is 2000 or less) in the obtained mass spectrum is performed, and it is checked whether a peak is present that corresponds to the composition in which an aliphatic compound is bonded to the molecular end.

In the present invention, it is desirable that in the molecular weight distribution, measured by gel permeation chromatography (GPC), of a chloroform soluble matter of the crystalline polyester resin, the content ratio of components with the number average molecular weight of 1000 or less be 5 mass % or less.

Where the content ratio of low-molecular weight components with the number average molecular weight of 1000 or less is above 5 mass %, the storability, charging performance, and anti-hot offset property tend to degrade. It is preferred that this content ratio be 4 mass % or less.

As described hereinabove, where the aliphatic compound is added in the process of synthesizing the crystalline polyester resin with a low molecular weight, the aliphatic compound reacts with the end of the molecular chain constituting the crystalline polyester resin. Therefore, practically the entire unreacted free monomer reacts and the amount of the low-molecular weight component derived from the unreacted monomers is reduced. This may be used to adjust the content ratio of components with a number average molecular weight of 1000 or less to the abovementioned range.

In the present invention, from the standpoint of low-temperature fixability, charging performance and heat-resistant storability, it is preferred that the content of the crystalline polyester resin be from 0.5 part by mass to 15.0 parts by mass, more preferably from 2.0 parts by mass to 10.0 parts by mass per 100 parts by mass of the amorphous polyester resin.

In the present invention, the crystalline polyester resin can be manufactured by the usual polyester synthesis method. For example, a crystalline polyester resin can be obtained by performing esterification or transesterification of the above-described carboxylic acid component and alcohol component, and then implementing condensation polymerization reaction by the usual method under a reduced pressure or by introducing nitrogen gas. The desired crystalline polyester resin can be thereafter obtained by adding the abovementioned aliphatic compound and performing esterification.

If necessary, the esterification or transesterification can be performed using the usual esterification catalyst or transesterification catalyst such as sulfuric acid, titanium butoxide, tin 2-ethylhexanoate, dibutyltin oxide, manganese acetate, and magnesium acetate.

Further, the condensation polymerization reaction can be implemented using the usual polymerization catalyst, for example, titanium butoxide, tin 2-ethylhexanoate, dibutyltin oxide, tin acetate, zinc acetate, tin disulfide, antimony trioxide, and germanium dioxide. The polymerization temperature and the amount of catalyst are not particularly limited and may be determined as appropriate.

A method of charging all of the monomers together may be used to increase the strength of the crystalline polyester resin obtained by the esterification, transesterification, and condensation polymerization reaction. Further, in order to reduce the amount of low-molecular weight component, a method may be used by which divalent monomers are initially reacted and then the reaction is performed by adding monomers with a valence of three or more.

<Amorphous Polyester Resin (Binder Resin)>

In the present invention, the toner particle includes an amorphous polyester resin as a binder resin.

In this case, the content ratio of the amorphous polyester resin in the binder resin is preferably 50 mass % or more, more preferably 70 mass % or more, even more preferably 90 mass % or more, and still more preferably 100 mass %.

Similarly to the crystalline polyester resin, the amorphous polyester resin can be manufactured by the usual polyester synthesis method.

Examples of monomers to be used in the manufacture of the amorphous polyester resin include polyhydric alcohols (dihydric, trihydric and higher polyhydric alcohols) and polyvalent carboxylic acids (divalent, trivalent or higher polyvalent carboxylic acids) and anhydrides thereof or lower alkyl esters thereof.

When a branched polymer is created in this case, an effective approach is to perform partial crosslinking in the molecule of the amorphous polyester resin. A polyfunctional compound with a valence of three or more may be used for this purpose. Thus, a trivalent and higher polyvalent carboxylic acid, an anhydride thereof, or a lower alkyl ester thereof, and/or a trihydric and higher polyhydric alcohol may be included as monomers.

Examples of the polyhydric alcohols and polyvalent carboxylic acids that can be used in the manufacture of the amorphous polyester resin are presented below.

Examples of dihydric alcohols include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A), and diols represented by the following formula (B).

[Chem. Formula 1]

(A)

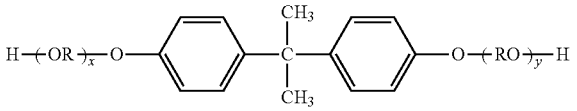

(where R is an ethylene or propylene group; x and y each are an integer of 0 or more, and the average value of x+y is from 0 to 10)

(B)

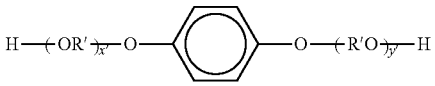

(where R' denotes

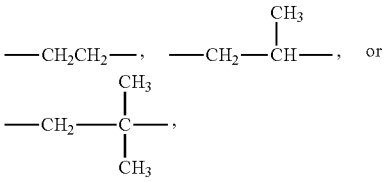

and x' and y' each are an integer of 0 or more, and the average value of x'+y' is from 0 to 10).

Examples of divalent carboxylic acids include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, and isooctylsuccinic acid. Anhydrides and lower alkyl esters thereof may be also used.

Among them, maleic acid, fumaric acid, terephthalic acid, adipic acid, and n-dodecenylsuccinic acid are preferably used.

Examples of trihydric and higher polyhydric alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among them, glycerol, trimethylolpropane, and pentaerythritol are preferred.

Examples of trivalent and higher polyvalent carboxylic acids include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and Empol trimer acid. Anhydrides and lower alkyl esters thereof may be also used.

Among them, 1,2,4-benzenetricarboxylic acid (trimellitic acid) and derivatives thereof can be advantageously used because they are inexpensive and the reaction thereof can be easily controlled.

The dihydric alcohols and trihydric and higher polyhydric alcohols can be used individually or a plurality thereof can be used. Likewise, divalent carboxylic acids and trivalent and higher polyvalent carboxylic acids can be used individually or a plurality thereof can be used.

In the present invention, the amorphous polyester resin may be a hybrid resin. For example, a hybrid resin may be used which is obtained by chemically bonding an amorphous polyester resin with a vinyl resin or vinyl copolymer.

In this case, the content ratio of the amorphous polyester resin in the hybrid resin is preferably 50 mass % or more, more preferably 70 mass % or more.

A hybrid resin of an amorphous polyester resin and a vinyl resin or vinyl copolymer can be manufactured by a method of performing a polymerization reaction of either one or both resins among a vinyl resin or vinyl copolymer and a polyester resin in a state in which polymers including reactable monomer components thereof are present.

Among the monomers constituting the amorphous polyester resin, examples of those reactable with vinyl resins or vinyl copolymers include unsaturated dicarboxylic acids such as phthalic acid, maleic acid, citraconic acid, and itaconic acid and anhydrides thereof.

Among the monomers constituting vinyl resins and vinyl copolymers, examples of those reactable with amorphous polyester resins include monomers having a carboxyl group or hydroxyl group, acrylic acid esters and methacrylic acid esters.

In the present invention, resins other than the amorphous polyester resin can be used as the binder resin, provided that the effect of the present invention is not lost.

Those other resins are not particularly limited, and examples thereof include resins that have been used as a binder resin for a toner particle. Specific examples include vinyl resins, phenolic resins, phenolic resins modified by natural resins, maleic resins modified by natural resins, acrylic resins, methacrylic resins, polyvinyl acetate resins, silicone resins, polyurethane resins, polyamide resins, furan resins, epoxy resins, xylene resins, polyvinyl butyral, terpene resins, coumarone indene resins, and petroleum-derived resins.

In the present invention, it is preferred that in a molecular weight distribution, measured by gel permeation chromatography (GPC), of the tetrahydrofuran (THF) soluble matter of the amorphous polyester resin, the peak molecular weight be from 4000 to 13,000. Such a range is preferred from the standpoint of low-temperature fixability and anti-hot offset property.

Further, from the standpoint of charging performance under high-temperature and high-humidity environment, it is preferred that the acid value of the amorphous polyester resin be from 15 mg KOH/g to 30 mg KOH/g.

Further, from the standpoint of low-temperature fixability and storability, it is preferred that the hydroxyl value of the amorphous polyester resin be from 2 mg KOH/g to 20 mg KOH/g.

In the present invention, the amorphous polyester resin can include a low-molecular-weight amorphous polyester resin C with a peak molecular weight of 4000 to 7500 and a high-molecular-weight amorphous polyester resin B with a peak molecular weight of 8500 to 11,000.

In this case, from the standpoint of low-temperature fixability and anti-hot offset property, it is preferred that the mixing ratio (B/C) of the high-molecular-weight amorphous polyester resin B and low-molecular-weight amorphous polyester resin C be from 10/90 to 60/40, on a mass basis.

Meanwhile from the standpoint of anti-hot offset property, it is preferred that the peak molecular weight of the high-molecular-weight amorphous polyester resin B be from 8500 to 9500. Further, from the standpoint of charging performance under high-temperature and high-humidity environment, it is preferred that the acid value of the high-molecular-weight amorphous polyester resin B be from 15 mg KOH/g to 30 mg KOH/g.

From the standpoint of low-temperature fixability, it is preferred that the peak molecular weight of the low-molecular-weight amorphous polyester resin C be from 5000 to 7000. Further, from the standpoint of charging performance under high-temperature and high-humidity environment, it is preferred that the acid value of the low-molecular-weight amorphous polyester resin C be 10 mg KOH/g or less.

The acid value, as referred to hereinabove, is the number of milligrams of potassium hydroxide necessary to neutralize the acid contained in 1 g of the sample. The acid value of resins is measured according to JIS K0070-1992.

<Wax>

The following waxes can be used for the toner particle of the toner of the present invention.

Hydrocarbon waxes such as low-molecular-weight polyethylene, low-molecular-weight polypropylene, alkylene copolymer, microcrystalline wax, paraffin wax, and Fischer-Tropsch wax; oxides of hydrocarbon waxes, such as polyethylene oxide wax, and block copolymers thereof; waxes including an aliphatic acid ester such as carnauba wax as the main component; and waxes obtained by partial or complete deoxidation of aliphatic acid esters, such as deoxidized carnauba wax.

Other examples are listed hereinbelow. Saturated linear fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; esters of fatty acids such as palmitic acid, stearic acid, behenic acid, and montanic acid with alcohols such as stearyl alcohol, aralkyl alcohol, behenyl alcohol, carnaubyl alcohol, ceryl alcohol, and melissyl alcohol; fatty acid amides such as linoleic acid amide, oleic acid amide, and lauric acid amide; saturated fatty acid bisamides such as methylene bis-stearic acid amide, ethylene bis-capric acid amide, ethylene bis-lauric acid amide, and hexamethylene bis-stearic acid amide; unsaturated fatty acid amides such as ethylene bis-oleic acid amide, hexamethylene bis-oleic acid amide, N,N'-dioleyladipic acid amide, and N,N'-dioleylsebacic acid amide; aromatic bisamides such as m-xylene bis-stearic acid amide and N,N'-distearylisophthalic acid amide; aliphatic metal salts such as calcium stearate, calcium laurate, zinc stearate, and magnesium stearate (typically those referred to as metallic soaps); waxes obtained by grafting a vinyl monomer such as styrene or acrylic acid to aliphatic hydrocarbon waxes; partially esterified fatty acids and polyhydric alcohols, such as monoglyceride behenate; and methyl ester compounds having a hydroxyl group obtained by hydrogenation of vegetable oils and fats.

Among these waxes, from the standpoint of improving the low-temperature fixability and anti-hot offset property, hydrocarbon waxes such as paraffin waxes and Fischer-Tropsch waxes, and fatty acid ester waxes such as a carnauba wax are preferred. In the present invention, from the standpoint of improving the anti-hot offset property, the hydrocarbon-based wax is more preferred.

In the present invention, the wax content is preferably from 1 part by mass to 20 parts by mass, more preferably from 3 parts by mass to 10 parts by mass per 100 parts by mass of the amorphous polyester resin. The abovementioned content range is more preferred in terms of ensuring both the storability and the anti-hot offset property.

It is also preferred that the peak temperature of the maximum endothermic peak of the wax, measured using differential scanning calorimeter (DSC), be from 45° C. to 140° C., more preferably from 60° C. to 100° C. From the standpoint of ensuring both the storability and the anti-hot offset property of the toner, it is more preferred that the peak temperature of the maximum endothermic peak of the wax be within the abovementioned range.

<Colorant>

Examples of colorants that can be used in the toner particle of the toner of the present invention are presented below.

A carbon black and colorants that were color matched to a black color by using a yellow colorant, a magenta colorant, and a cyan colorant can be used for the black toner. A pigment may be used individually for the colorant, but from the standpoint of quality of a full-color image, it is preferred that the definition of the colorant be increased by using a dye together with a pigment.

Examples of pigments for magenta toners are presented below. C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57: 1, 58, 60, 63, 64, 68, 81:1, 83, 87, 88, 89, 90, 112, 114, 122, 123, 146, 147, 150, 163, 184, 202, 206, 207, 209, 238, 269, and 282; C. I. Pigment Violet 19; C. I. Vat Red 1, 2, 10, 13, 15, 23, 29, and 35.

Examples of dyes for magenta toners are presented below. Oil-soluble dyes such as C. I. Solvent Red 1, 3, 8, 23, 24, 25, 27, 30, 49, 81, 82, 83, 84, 100, 109, and 121; C. I. Disperse Red 9; C. I. Solvent Violet 8, 13, 14, 21, and 27; and C. I. Disperse Violet 1, and basic dyes such as C. I. Basic Red 1, 2, 9, 12, 13, 14, 15, 17, 18, 22, 23, 24, 27, 29, 32, 34, 35, 36, 37, 38, 39, and 40; and C. I. Basic Violet 1, 3, 7, 10, 14, 15, 21, 25, 26, 27, and 28.

Examples of pigments for cyan toners are presented below. C. I. Pigment Blue 2, 3, 15:2, 15:3, 15:4, 16, and 17;

C. I. Vat Blue 6; C. I. Acid Blue 45, and a copper phthalocyanine pigment in which 1 to 5 phthalimidomethyl groups are substituted in a phthalocyanine skeleton.

C. I. Solvent Blue 70 can be used as a dye for cyan toners.

Examples of pigments for yellow toners are presented below. C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185; C. I. Vat Yellow 1, 3, and 20.

C. I. Solvent Yellow 162 can be used as a dye for yellow toners.

The content of the colorant is preferably from 0.1 part by mass to 30 parts by mass per 100 parts by mass of the amorphous polyester resin.

<Charge Control Agent>

In the present invention, the toner particle may include, as necessary, a charge control agent.

A metal compound of an aromatic carboxylic acid which is colorless and enables a high charging speed of the toner and stable retention of a predetermined charge amount is preferred as the charge control agent.

Examples of charge control agents of a negative system include:

metal compounds of salicylic acid;

metal compounds of naphthoic acid;

metal compounds of dicarboxylic acids;

polymer-type compounds having a sulfonic acid or carboxylic acid in a side chain;

polymer-type compounds having a sulfonic acid salt or sulfonic acid ester in a side chain;

polymer-type compounds having a carboxylic acid salt or carboxylic acid ester in a side chain;

boron compounds;

urea compounds;

silicon compounds; and calixarenes.

Examples of charge control agents of a positive system include:

quaternary ammonium salts;

polymer-type compounds having a quaternary ammonium salt in a side chain;

guanidine compounds; and imidazole compounds.

The charge control agent may be internally or externally added to the toner particle.

The content of the charge control agent is preferably 0.2 part by mass to 10 parts by mass per 100 parts by mass of the amorphous polyester resin.

<Inorganic Fine Particle>

The toner particle of the toner according to the present invention may include, as necessary, an inorganic fine particle.

The inorganic fine particle may be internally added to the toner particle, or may be included as an external additive in the toner.

When the inorganic fine particle is included as an external additive, a fine silica particle, a fine titanium oxide particle, and a fine aluminum oxide particle are preferred.

The inorganic fine particle is preferably hydrophobized by a hydrophobic agent such as a silane compound, silicone oil, or a mixture thereof.

When the inorganic fine particle is used to improve the toner flowability, the specific surface area thereof is preferably from 50 $m^2/g$ to 400 $m^2/g$.

Meanwhile, where the inorganic fine particle is used to improve the toner durability, the specific surface area thereof is preferably from 10 $m^2/g$ to 50 $m^2/g$.

In order to improve both the flowability and the durability, inorganic fine particles with the specific surface area within the abovementioned ranges may be used together.

When the inorganic fine particle is included as an external additive, the content thereof is preferably from 0.1 part by mass to 10.0 parts by mass per 100 parts by mass of the toner particle. A mixer such as a Henschel mixer may be used for mixing the toner particle and inorganic fine particle.

<Developer>

The toner of the present invention can be used as a one-component developer, but in order to improve further the dot reproducibility and also to provide stable images over a long period of time, it is preferred that the toner be used as a two-component developer in a mixture with a magnetic carrier.

Examples of magnetic carriers include:

iron oxide;

particles of metals such as iron, lithium, calcium, magnesium, nickel, copper, zinc, cobalt, manganese, chromium, and rare earth metals, particles of alloys thereof, and particles of oxides thereof;

magnetic bodies such as ferrites; and magnetic body dispersion resin carriers (the so-called resin carriers) including a magnetic body and a binder resin that holds the magnetic body in a dispersed state.

When the toner of the present invention is mixed with a magnetic carrier and used as a two-component developer, the mixing ratio of the magnetic carrier and toner is preferably such that the toner concentration in the two-component developer is from 2 mass % to 15 mass %, more preferably from 4 mass % to 13 mass %.

<Manufacturing Method>

A method for manufacturing the toner of the present invention is not particularly limited, but in order to further improve the dispersibililty of the crystalline polyester resin and better demonstrate the effect of the present invention, a pulverization method may be used. A procedure for manufacturing the toner by using the pulverization method will be explained hereinbelow.

Initially, in the raw material mixing step, the crystalline polyester resin, amorphous polyester resin, wax, and colorant are weighed in predetermined amounts as raw materials for the toner (toner particle), blended, and mixed.

Examples of devices that can be used for mixing include HENSCHEL MIXER (manufactured by NIPPON COKE & ENGINEERING CO., LTD.); SUPER MIXER (manufactured by KAWATAMFG CO., LTD.); RIBOCONE (manufactured by OKAWARA MFG. CO., LTD.); NAUTA MIXER, TURBULIZER, CYCLOMIX (manufactured by Hosokawa Micron Group); SPIRAL PIN MIXER (manufactured by Pacific Machinery & Engineering Co., Ltd); and LEDIGE MIXER (manufactured Matsubo Corporation).

The mixture obtained is then melt kneaded, the resins are melted, and the wax and colorant are dispersed therein (melt kneading step).

Examples of devices that can be used for melt kneading include a TEM-TYPE EXTRUDER (manufactured by Toshiba Machine Co., Ltd.); TEX TWIN-SCREW KNEADER (Japan Steel Works, Ltd.); PCM KNEADER (manufactured by Ikegai Corp.); and KNEADEX (manufactured by Mitsui Mining CO., LTD). However, a continuous kneading machine, such as a single-screw or twin-screw extruder is preferred over a batch kneading machine because continuous production is enabled.

The obtained melt-kneaded product is rolled with two rolls and cooled by water cooling. The resulting cooled product is pulverized to the desired particle size. Initially coarse pulverization is performed with a crusher, a hammer mill, or a feather mill, and then fine pulverization is performed with CRYPTRON SYSTEM (manufactured by Kawasaki Heavy Industries, Ltd.) or SUPER ROTOR (Nisshin Engineering Inc., Ltd.) to obtain toner particles.

The resulting toner particles are classified to the desired particle size. Examples of suitable classification devices include TURBOPLEX, FACULTY, TSP, TTSP (manufactured by Hosokawa Micron Corporation) and ELBOW JET (manufactured by Nittetsu Mining Co., Ltd.).

Further, the inorganic fine particle may be externally added, as necessary, to the toner particle. A method for adding the inorganic fine particle can include blending the toner particle and inorganic fine particle in predetermined amounts and stirring and mixing by using a high-speed stirrer that imparts a shear force to the powder. Examples of high-speed stirrers for imparting a shear force to the powder include HENSCHEL MIXER and MECHANO HYBRID (manufactured by NIPPON COKE & ENGINEERING CO., LTD.) and SUPER MIXER and NOVILTA (manufactured by Hosokawa Micron Corporation).

If necessary, a sieving machine, for example, such as ULTRASONIC (manufactured by Koei Sangyo Co., Ltd.), RESONASIEVE and GYROSIFTER (manufactured by TOKUJU CORPORATION); TURBO SCREENER (manufactured by Turbo Kogyo Co., Ltd.), and HIVOLTER (manufactured by Toyo Hitec Co., Ltd.), may be used.

Methods for measuring physical properties of the toner and raw materials are explained hereinbelow.

(Separation of Crystalline Polyester Resin>

The toner is placed in methyl ethyl ketone (MEK) and allowed to stay for several hours at 25° C. The toner and MEK are then thoroughly mixed by vigorous shaking and then further allowed to stay for 12 h or more in a stationary state till sample aggregates are eliminated. The resulting solution is centrifugally separated for 20 min at 3500 rpm (centrifuge "H-18", manufactured by KOKUSAN Co. Ltd.), and the solid matter is thereafter recovered and dried.

The dried sample is dissolved in MEK under heating at 75° C., and the crystalline polyester resin is obtained from the supernatant separated by centrifugal separation <Measurement of Molecular Weight Distribution of Crystalline Polyester Resin>

The molecular weight distribution of the crystalline polyester resin is measured in the following manner by using gel permeation chromatography (GPC).

Initially, 50 mg of the sample is placed into 5 mL of chloroform and allowed to stay for several hours at 25° C. The sample is then thoroughly mixed with the chloroform by vigorous shaking and then further allowed to stay in a stationary state for 24 h or more till sample aggregates are eliminated.

The resulting solution is filtered with a solvent-resistant membrane filter "MYSHORI DISK H-25-5" (manufactured by Tosoh Corp.) with a pore diameter of 0.5 μm and a sample solution is obtained. The measurements are performed by using the sample solution under the following conditions.

Device: High-speed GPC device "Labsolutions GPC" (manufactured by SHIMADZU CORPORATION).

Column: PLgel 5 μm MIXED-C 300×7.5 mm (manufactured by Agilent Technologies): two columns; PLgel 5 μm Guard 50×7.5 mm (manufactured by Agilent Technologies): one column.

Eluent: chloroform.

Flow velocity: 1.0 mL/min.

Oven temperature: 45° C.

Poured amount of sample: 60 μL.

Detector: RI (refractive index) detector.

The weight-average molecular weight (Mw), number average molecular weight (Mn), and peak molecular weight (Mp) of the sample are calculated using a molecular wave calibration curve plotted using standard polystyrene resins (trade name "TSK Standard Polystyrene F-850, F-450, F-288, F-128, F-80, F-40, F-20, F-10, F-4, F-2, F-1, A-5000, A-2500, A-1000, A-500", manufactured by Tosoh Corp.).

The content ratio (units: mass %) of components with a number average molecular weight of 1000 or less is calculated from the intersection of the integrated molecular weight distribution curve and the number average molecular weight 1000.

<Measurement of Molecular Weight Distribution of Amorphous Polyester Resin>

The molecular weight distribution of the amorphous polyester resin is measured in the following manner by using gel permeation chromatography (GPC).

Initially, the sample is placed in tetrahydrofuran (THF) and allowed to stay for several hours at 25° C. The sample is then thoroughly mixed with the THF by vigorous shaking and then further allowed to stay in a stationary state for 12 h or more till sample aggrebgations are eliminated.

When the sample is a crystalline polyester resin, the dissolution is performed at least for 72 h or longer.

The resulting solution is filtered with a solvent-resistant membrane filter "MYSHORI DISK" (manufactured by Tosoh Corp.) with a pore diameter of 0.5 μm and a sample solution is obtained. The sample solution is adjusted to the concentration of THF solubles of 0.8 mass %. The measurements are performed by using the sample solution under the following conditions.

Device: High-speed GPC device "HLC-8220GPC" (manufactured by Tosoh Corp.).

Column: Shodex GPC KF-801, 802, 803, 804, 805, 806, 807, 800P (manufactured by Show Denko K.K.).

Eluent: THF.

Flow velocity: 1.0 mL/min.

Oven temperature: 40° C.

Poured amount of sample: 100 μL.

Detector: RI (refractive index) detector.

The weight-average molecular weight (Mw), number average molecular weight (Mn), and peak molecular weight (Mp) of the sample are calculated using a molecular wave calibration curve plotted using standard polystyrene resins (trade name "TSK Standard Polystyrene F-850, F-450, F-288, F-128, F-80, F-40, F-20, F-10, F-4, F-2, F-1, A-5000, A-2500, A-1000, A-500", manufactured by Tosoh Corp.).

<Measurement of Peak Top Temperature of Maximum Endothermic Peak of Wax and Melting Point of Crystalline Polyester Resin>

The peak top temperature of the maximum endothermic peak of the wax and crystalline polyester resin is measured according to ASTM D3418-82 by using a differential scanning calorimeter "Q1000" (manufactured by TA Instruments).

The melting points of indium and zinc are used for temperature correction of the device detection unit, and the heat of fusion of indium is used for correcting the amount of heat.

More specifically, 5 mg of the sample is weighed and placed into a silver pan. A hollow silver pan is used as a reference. One measurement is performed at a ramp rate of 10° C./min from a measurement start temperature of 20° C. to a measurement end temperature of 180° C. The peak top temperature of the maximum endothermic peak of the DSC curve in the temperature range from 20° C. to 180° C. in this first temperature increase process is determined.

In the present invention the peak top temperature of the maximum endothermic peak when the wax is the sample is also referred to as the melting point of the wax.

The peak top temperature of the maximum endothermic peak when the crystalline polyester resin is the sample is also referred to as the melting point of the crystalline polyester resin.

When a toner is used as the sample, an endothermic peak caused by the wax present inside the toner particle of the toner is sometimes observed. The endothermic peak of the wax and the endothermic peak of the crystalline polyester resin are distinguished from each other in the following manner. Thus, initially, the wax is extracted from the toner particle of the toner by Soxhlet extraction using a hexane solvent. Then, the differential scanning calorimetry of the wax alone is performed by the above-described manner and the resulting endothermic peak is compared with the endothermic peak of the toner, thereby performing the aforementioned distinction.

<Measurement of Glass Transition Temperature (Tg) of the Resin>

The glass transition temperature (Tg) of the resin is measured according to ASTM D3418-82 by using a differential scanning calorimeter "Q1000" (manufactured by TA Instruments).

The melting points of indium and zinc are used for temperature correction of the device detection unit, and the heat of fusion of indium is used for correcting the amount of heat.

More specifically, 5 mg of the resin composition is weighed and placed into a silver pan. A hollow silver pan is used as a reference, and measurements are performed at a ramp rate of 10° C./min in a temperature range from 30° C. to 180° C.

The temperature is once raised to 180° C., held for 10 min, lowered to 30° C., and then increased again. In the second temperature increase process, the specific heat changes in the range from 30° C. to 180° C. The temperature at the intersection point of a straight line at equal distance in the ordinate direction from a straight line obtained by extending the base line representing the states before and after the change in the specific heat, and the curve of the stepwise change portion of glass transition in the DSC curve is taken as the glass transition temperature (Tg: ° C.) of the resin.

EXAMPLES

The present invention will be explained hereinbelow in greater detail on the basis of manufacturing examples and exemplary embodiments thereof, but the present invention is not intended to be limited thereto. The number of parts and "%" in the composition below are all on the mass basis, unless specifically stated otherwise.

<Manufacturing Example of Crystalline Polyester Resin A1>

| | |
|---|---|
| 1,6-Hexanediol: | 34.5 parts by mass |
| (0.29 mol; 100.0 mol % with respect to the total number of moles of the polyhydric alcohol); | |
| Dodecane diacid: | 65.5 parts by mass |
| (0.28 mol; 100.0 mol % with respect to the total number of moles of the polyvalent carboxylic acid); | |
| Tin 2-ethylhexanoate | 0.5 part by mass. |

The above-described materials were weighed in a reaction vessel equipped with a cooling tube, a stirrer, a nitrogen introducing tube, and a thermocouple. The inside of a flask was purged with nitrogen, the temperature was then gradually raised under stirring, and the reaction was conducted for 3 h under stirring at a temperature of 140° C.

The pressure inside the reaction vessel was then lowered to 8.3 kPa, and the reaction was conducted for 4 h while maintaining the temperature at 200° C.

The pressure inside the reaction vessel was then gradually released and returned to the atmospheric pressure. Then, 10.0 parts by mass of the aliphatic compound (stearic acid) presented in Table 1 was added per 100 parts by mass of the starting material monomer and the reaction was conducted for 2 h at 200° C. under a normal pressure.

The pressure inside the reaction vessel was then again reduced to 5 kPa or less and the reaction was conducted for 3 h at a temperature of 200° C., thereby obtaining the crystalline polyester resin A1.

The content ratio of the components with the weight-average molecular weight (Mw) and number average molecular weight of the resulting crystalline polyester resin A1 being 1000 or less (units: mass %; denoted by A* in the table) are presented in Table 1.

<Manufacturing Examples of Crystalline Polyester Resins A2 to A22>

In the manufacturing example of the crystalline polyester resin A1, the conditions were changed, as appropriate, to obtain the dicarboxylic acid, diol, aliphatic compound, added amount of the aliphatic compound, and weight-average molecular weight (Mw) of the crystalline polyester resin such as shown in Table 1. In other aspects, the crystalline polyester resins A2 to A22 were obtained by performing the same operations as in the manufacturing example of the crystalline polyester resin A1.

The weight-average molecular weight (Mw) of the resulting crystalline polyester resins and the content ratio (mass %) of components with the number average molecular weight of 1000 or less are shown in Table 1.

TABLE 1

| Crystalline polyester resin | Constituent monomers | | Molecular weight | | Aliphatic compound | | |
|---|---|---|---|---|---|---|---|
| | | | Molecular weight | | | Content ratio | Melting point |
| No. | Dicarboxylic acid | Diol | (Mw) | A* | Type | (mass %) | [° C.] |
| A1 | dodecanedioic acid (C12) | 1,6-Hexanediol (C6) | 10200 | 1.9 | Stearic acid (C18) | 9.1 | 70.6 |

TABLE 1-continued

| Crystalline polyester resin | Constituent monomers | | Molecular weight | | Aliphatic compound | | |
|---|---|---|---|---|---|---|---|
| | | | Molecular weight | | | Content ratio | Melting point |
| No. | Dicarboxylic acid | Diol | (Mw) | A* | Type | (mass %) | [° C.] |
| A2 | ↑ | ↑ | 8100 | 2.6 | ↑ | ↑ | 69.4 |
| A3 | ↑ | ↑ | 10800 | 1.7 | ↑ | ↑ | 71.2 |
| A4 | ↑ | ↑ | 13800 | 1.4 | ↑ | ↑ | 71.4 |
| A5 | ↑ | ↑ | 5300 | 3.1 | ↑ | ↑ | 67.6 |
| A6 | Adipic acid (C6) | 1,12-Dodecanediol (C12) | 5400 | 3.2 | ↑ | ↑ | 72.4 |
| A7 | Sebacic acid (C10) | 1,10-Decanediol (C10) | 5600 | 2.8 | ↑ | ↑ | 75.1 |
| A8 | Sebacic acid (C10) | 1,6-Hexanediol (C6) | 5500 | 3.4 | ↑ | ↑ | 65.6 |
| A9 | tetradecanedioic acid (C14) | Butanediol (C4) | 5500 | 3.7 | ↑ | ↑ | 74.2 |
| A10 | ↑ | ↑ | 5200 | 5.0 | ↑ | 4.8 | 73.8 |
| A11 | ↑ | ↑ | 5300 | 5.7 | ↑ | 2.0 | 72.9 |
| A12 | ↑ | ↑ | 5500 | 3.1 | ↑ | 13.0 | 74.2 |
| A13 | ↑ | ↑ | 5400 | 7.4 | ↑ | 0.5 | 68.1 |
| A14 | ↑ | ↑ | 5200 | 7.5 | Arachidic acid (C20) | ↑ | 70.1 |
| A15 | ↑ | ↑ | 5000 | 7.6 | Octanoic acid (C8) | ↑ | 67.3 |
| A16 | ↑ | ↑ | 4900 | 8.3 | — | 0.0 | 64.0 |
| A17 | ↑ | ↑ | 5600 | 2.4 | Stearic acid (C18) | 15.3 | 74.9 |
| A18 | ↑ | ↑ | 5200 | 7.5 | Behenic acid (C22) | 0.5 | 74.2 |
| A19 | ↑ | ↑ | 5100 | 7.5 | Caproic acid (C6) | 0.5 | 67.0 |
| A20 | ↑ | ↑ | 4100 | 9.9 | Stearic acid (C18) | 0.5 | 63.3 |
| A21 | ↑ | ↑ | 15600 | 2.9 | — | 0.0 | 68.4 |
| A22 | ↑ | ↑ | 15200 | 0.8 | Stearic acid (C18) | 9.1 | 75.0 |

<Manufacturing Example of Amorphous Polyester Resin B (High Molecular Weight)>

| | |
|---|---|
| Polyoxypropylene (2.2)-2,2-bis (4-hydroxyphenyl)propane: (0.20 mol; 100.0 mol % with respect to the total number of moles of the polyhydric alcohol); | 72.3 parts by mass |
| Terephthalic acid: (0.11 mol; 65.0 mol % with respect to the total number of moles of polyvalent carboxylic acid); | 18.3 parts by mass |
| Fumaric acid: (0.03 mol; 15.0 mol % with respect to the total number of moles of the polyvalent carboxylic acid); | 2.9 parts by mass |
| Tin 2-ethylhexanoate (esterification catalyst) | 0.5 part by mass. |

The above-described materials were weighed in a reaction vessel equipped with a cooling tube, a stirrer, a nitrogen introducing tube, and a thermocouple. The inside of a flask was purged with nitrogen, the temperature was then gradually raised under stirring, and the reaction was conducted for 2 h under stirring at a temperature of 200° C.

The pressure inside the reaction vessel was then lowered to 8.3 kPa and maintained for 1 h, followed by cooling to 180° C. and returning to the atmospheric pressure (first reaction step)

Trimellitic acid anhydride: 6.5 parts by mass (0.03 mol; 20.0 mol % with respect to the total number of moles of the polyvalent carboxylic acid);

| | |
|---|---|
| Tert-butyl catechol (polymerization inhibitor) | 0.1 part by mass. |

The above-described materials were then added, the pressure inside the reaction vessel was lowered to 8.3 kPa, and the reaction was conducted for 15 h, while maintaining the temperature at 160° C. After it was confirmed that the softening point measured according to ASTM D36-86 has reached the desired temperature, the temperature was lowered and the reaction was stopped (second reaction step). The amorphous polyester resin B was thus obtained. The softening point of the resulting amorphous polyester resin was 135° C., the glass transition temperature was 63° C., and the peak molecular weight was 9011.

<Manufacturing Example of Amorphous Polyester Resin C (Low Molecular Weight)>

| | |
|---|---|
| Polyoxypropylene (2.2)-2,2-bis(4-hydroxyphenyl)propane: (0.20 mol; 100.0 mol % with respect to the total number of moles of the polyhydric alcohol); | 72.0 parts by mass |
| Terephthalic acid: (0.17 mol; 96.2 mol % with respect to the total number of moles of polyvalent carboxylic acid); | 28.0 parts by mass |
| Tin 2-ethylhexanoate (esterification catalyst) | 0.5 part by mass. |

The above-described materials were weighed in a reaction vessel equipped with a cooling tube, a stirrer, a nitrogen introducing tube, and a thermocouple. The inside of a flask was purged with nitrogen, the temperature was then gradually raised under stirring, and the reaction was conducted for 4 h under stirring at a temperature of 200° C.

The pressure inside the reaction vessel was then lowered to 8.3 kPa and maintained for 1 h, followed by cooling to 180° C. and returning to the atmospheric pressure (first reaction step)

Trimellitic acid anhydride: 1.3 part by mass (0.0068 mol; 3.8 mol % with respect to the total number of moles of the polyvalent carboxylic acid);

| | |
|---|---|
| Tert-butyl catechol (polymerization inhibitor) | 0.1 part by mass. |

The above-described materials were then added, the pressure inside the reaction vessel was lowered to 8.3 kPa, and the reaction was conducted for 1 h, while maintaining the temperature at 180° C. After it was confirmed that the softening point measured according to ASTM D36-86 has reached the desired temperature, the temperature was lowered and the reaction was stopped (second reaction step). The amorphous polyester resin C was thus obtained. The softening point of the resulting binder resin C was 87° C., the glass transition temperature was 53° C., and the peak molecular weight was 6264.

<Manufacturing Example of Toner 1>

| | |
|---|---|
| Amorphous polyester resin B | 35 parts by mass |
| Amorphous polyester resin C | 65 parts by mass |
| Crystalline polyester resin A1 | 7.5 parts by mass |
| Fischer-Tropsch wax (hydrocarbon wax, peak temperature of the maximum endothermic peak is 90° C.) | 6 parts by mass |
| C.I. Pigment Blue 15:3 | 7 parts by mass |
| 3.5-Di-t-butylsalicylic acid aluminum compound (BONTRON E88, manufactured by Orient Chemical Industries Co., Ltd.). | 0.3 part by mass |

The above-described materials were mixed at a revolution speed of 20 $s^{-1}$ for a revolution time of 5 min by using a Henschel mixer (FM-75 type, manufactured Mitsui Kosan CO., LTD), and then kneaded with a twin-shaft kneader (PCM-30 type, manufactured by Ikegai Corp.) set to a temperature of 130° C. The resulting kneaded matter was cooled and coarsely pulverized with a hammer mill to a size of 1 mm or less to obtain a coarsely pulverized product. The resulting coarsely pulverized product was finely pulverized with a mechanical pulverizer (T-250, manufactured by Turbo Industries). Classification was then performed using FACULTY F-300, manufactured by Hosokawa Micron Corp.), and toner particles 1 were obtained. The FACULTY F-300 was operated under the following conditions: classification rotor revolution speed 130 $s^{-1}$ and dispersing rotor revolution speed 120 $s^{-1}$.

A total of 1.0 part by mass of hydrophobic silica microparticles (BET: 200 $m^2/g$) that were hydrophobized with hexamethyldisilazane and 1.0 part by mass of titanium oxide microparticles (BET: 80 $m^2/g$) that were surface treated with isobutyltrimethoxysilane were mixed with 100 parts by mass of the resulting toner particles by using a Henschel mixer (FM-75 type, manufactured by Matsui Miike Machinery CO., LTD.) at a revolution speed of 30 $s^{-1}$ for a revolution time of 10 min, thereby producing a toner 1.

<Manufacturing Examples of Toners 2 to 28>

Toners 2 to 28 were obtained by performing the same operations as in the manufacturing example of toner 1, except that the type of the crystalline polyester resin and the amount of the crystalline polyester resin (number of added parts: parts by mass) were changed as indicated in Table 2.

TABLE 2

| Toner No. | Crystalline polyester No. | Number of added parts |
|---|---|---|
| Toner 1 | Crystalline polyester A1 | 7.5 |
| Toner 2 | ↑ | 3.0 |
| Toner 3 | ↑ | 10.0 |
| Toner 4 | ↑ | 0.5 |
| Toner 5 | ↑ | 15.0 |
| Toner 6 | ↑ | 16.0 |
| Toner 7 | ↑ | 0.35 |
| Toner 8 | Crystalline polyester A2 | 0.5 |
| Toner 9 | Crystalline polyester A3 | 0.5 |
| Toner 10 | Crystalline polyester A4 | 0.5 |
| Toner 11 | Crystalline polyester A5 | 0.5 |
| Toner 12 | Crystalline polyester A6 | 0.5 |
| Toner 13 | Crystalline polyester A7 | 0.5 |
| Toner 14 | Crystalline polyester A8 | 0.5 |
| Toner 15 | Crystalline polyester A9 | 0.5 |
| Toner 16 | Crystalline polyester A10 | 0.5 |
| Toner 17 | Crystalline polyester A11 | 0.5 |
| Toner 18 | Crystalline polyester A12 | 0.5 |
| Toner 19 | Crystalline polyester A13 | 0.5 |
| Toner 20 | Crystalline polyester A14 | 0.5 |
| Toner 21 | Crystalline polyester A15 | 0.5 |
| Toner 22 | Crystalline polyester A16 | 0.5 |
| Toner 23 | Crystalline polyester A17 | 0.5 |
| Toner 24 | Crystalline polyester A18 | 0.5 |
| Toner 25 | Crystalline polyester A19 | 0.5 |
| Toner 26 | Crystalline polyester A20 | 0.5 |
| Toner 27 | Crystalline polyester A21 | 0.5 |
| Toner 28 | Crystalline polyester A22 | 0.5 |

<Manufacturing Example of Magnetic Core Particle 1>

Step 1 (Weighing and Mixing Step)

| | |
|---|---|
| $Fe_2O_3$ | 62.7 parts by mass |
| $MnCO_3$ | 29.5 parts by mass |
| $Mg(OH)_2$ | 6.8 parts by mass |
| $SrCO_3$ | 1.0 part by mass |

The above-described ferrite raw materials were weighed to obtain the abovementioned composition ratio. Then, pulverization and mixing were performed for 5 h with a dry vibration mill using stainless steel beads with a diameter of ⅛ inch.

Step 2 (Pre-Firing Step)

The resulting pulverized product was pelletized into square pellets with a size of about 1 mm with a roller compactor. The pellets were processed to remove a coarse powder with a vibration sieve with 3-mm openings, and then a fine powder was removed with a vibration sieve with 0.5-mm openings. Firing was then performed for 4 h at a temperature of 1000° C. under a nitrogen atmosphere (oxygen concentration 0.01 vol %) by using a burner-type firing furnace, thereby producing a pre-fired ferrite. The resulting pre-fired ferrite had the following composition:

$$(MnO)_a(MgO)_b(SrO)_c(Fe_2O_3)_d,$$

where a=0.257, b=0.117, c=0.007, d=0.393.

Step 3 (Pulverizing Step)

After the pulverization to a size of about 0.3 mm with a crusher, 30 parts by mass of water was added to 100 parts by mass of the pre-fired ferrite and the ferrite was pulverized for 1 h in a wet ball mill by using zirconia beads with a diameter of ⅛ inch. The slurry obtained was pulverized for 4 h in a wet ball mill using alumina beads with a diameter of 1/16 inch, and a ferrite slurry (finely crushed product of the pre-fired ferrite) was obtained.

Step 4 (Granulating Step)

A total of 1.0 part by mass of ammonium polycarboxylate as a dispersing agent and 2.0 parts by mass of polyvinyl alcohol as a binder were added per 100 parts by mass of the pre-fired ferrite to the ferrite slurry, and granulation into spherical particles was performed with a spray drier (manufactured by Ohkawara Kakohki Co., Ltd.). The particle size of the resulting particles was adjusted, followed by heating for 2 h at 650° C. in a rotary kiln and removal of organic components of the dispersing agent and binder.

Step 5 (Firing Step)

The temperature was raised from room temperature to 1300° C. over a period of 2 h under a nitrogen atmosphere (concentration of oxygen: 1.00 vol %) in an electric furnace to control the firing atmosphere, and then the firing was performed for 4 h at 1150° C. The temperature was then lowered to 60° C. over a period of 4 h, the nitrogen atmosphere was replaced with the air, and the fired product was taken out at a temperature of 40° C. or lower.

Step 6 (Sorting Step)

The aggregated particles were crushed, a low-magnetic product was separated by magnetic separation, coarse particles were removed by sieving with a sieve with openings of 250 μm, and magnetic core particles 1 with a 50% particle diameter on a volume basis (D50) of 37.0 μm were obtained.

<Preparation of Coating Resin 1>

| | |
|---|---|
| Cyclohexyl methacrylate monomer | 26.8 mass % |
| Methyl methacrylate monomer | 0.2 mass % |
| Methyl methacrylate macromonomer (macromonomer with a weight-average molecular weight of 5000 which has a methacryloyl group at one end) | 8.4 mass % |
| Toluene | 31.3 mass % |
| Methyl ethyl ketone | 31.3 mass % |
| Azobisisobutyronitrile | 2.0 mass %. |

Among the abovementioned materials, the cyclohexyl methacrylate monomer, methyl methacrylate monomer, methyl methacrylate macromonomer, toluene, and methyl ethyl ketone were placed in a four-neck separable flask equipped with a reflux cooler, a thermometer, a nitrogen introducing type, and a stirrer, nitrogen gas was then introduced to obtain a sufficient nitrogen atmosphere, and the content was heated to 80° C. Then, azobisisobutyronitrile was added to perform 5-h reflux and polymerization. A coating resin 1 was then obtained by pouring hexane into the resulting reaction product, precipitating a copolymer, filtering out the precipitate, and drying under vacuum. A total of 30 parts by mass of the resulting coating resin 1 was dissolved in 40 parts by mass of toluene and 30 parts by mass of methyl ethyl ketone to obtain a polymer solution 1 (content of solids 30 mass %).

<Preparation of Coating Resin Solution 1>

| | |
|---|---|
| Polymer solution 1 (concentration of resin solid component 30%) | 33.3 mass % |
| Toluene | 66.4 mass % |
| Carbon black (Regal 330; manufactured by Cabot Corp.) (primary particle diameter 25 nm, specific surface area measured by nitrogen adsorption 94 $m^2/g$, DBP absorption 75 mL/100 g). | 0.3 mass % |

The abovementioned material were dispersed for 1 h with a paint shaker by using zirconia beads with a diameter of 0.5 mm. The resulting dispersion was filtered with a 5.0-μm membrane filter to obtain a coating resin solution 1.

<Manufacturing Example of Magnetic Carrier 1> (Resin Coating Process)

The coating resin solution 1 was charged into a vacuum degassing kneader maintained at a normal temperature to obtain 2.5 parts by mass of the resin component per 100 parts by mass of the magnetic core particles 1. After the charging, stirring was performed for 15 min at a revolution speed of 30 rpm, the solvent was evaporated to a predetermined level or higher (80 mass %), the temperature was then raised to 80° C. while mixing under a reduced pressure, and the toluene was distilled off over a period of 2 h, followed by cooling.

A magnetic carrier 1 with a 50% particle diameter on a volume basis (D50) of 38.2 μm was then obtained by separating a low-magnetic component from the resulting magnetic carrier by magnetic separation, sieving with a 70-1 μm sieve, and then classifying with an air classifier.

<Manufacturing Example of Two-Component Developer 1>

The toner 1 was added at a ratio of 8.0 parts by mass per 92.0 parts by mass of the magnetic carrier 1, and the components were mixed in a V-type mixer (V-20, manufactured by Seishin Enterprise Co., Ltd.) to obtain a two-component developer 1.

<Manufacturing Example of Two-Component Developers 2 to 28>

Two-component developers 2 to 28 were obtained by performing the operations of the manufacturing example of the two-component developer 1, except that the toner combinations were changed as indicated in Table 3.

TABLE 3

| Example No. | Toner No. | Magnetic carrier No. | Two-component developer No. |
|---|---|---|---|
| Example 1 | Toner 1 | Magnetic carrier 1 | Two-component developer 1 |
| Example 2 | Toner 2 | ↑ | Two-component developer 2 |
| Example 3 | Toner 3 | ↑ | Two-component developer 3 |
| Example 4 | Toner 4 | ↑ | Two-component developer 4 |
| Example 5 | Toner 5 | ↑ | Two-component developer 5 |
| Example 6 | Toner 6 | ↑ | Two-component developer 6 |
| Example 7 | Toner 7 | ↑ | Two-component developer 7 |
| Example 8 | Toner 8 | ↑ | Two-component developer 8 |
| Example 9 | Toner 9 | ↑ | Two-component developer 9 |
| Example 10 | Toner 10 | ↑ | Two-component developer 10 |
| Example 11 | Toner 11 | ↑ | Two-component developer 11 |
| Example 12 | Toner 12 | ↑ | Two-component developer 12 |
| Example 13 | Toner 13 | ↑ | Two-component developer 13 |
| Example 14 | Toner 14 | ↑ | Two-component developer 14 |
| Example 15 | Toner 15 | ↑ | Two-component developer 15 |
| Example 16 | Toner 16 | ↑ | Two-component developer 16 |
| Example 17 | Toner 17 | ↑ | Two-component developer 17 |
| Example 18 | Toner 18 | ↑ | Two-component developer 18 |
| Example 19 | Toner 19 | ↑ | Two-component developer 19 |
| Example 20 | Toner 20 | ↑ | Two-component developer 20 |
| Example 21 | Toner 21 | ↑ | Two-component developer 21 |
| Comparative Example 1 | Toner 22 | ↑ | Two-component developer 22 |
| Comparative Example 2 | Toner 23 | ↑ | Two-component developer 23 |
| Comparative Example 3 | Toner 24 | ↑ | Two-component developer 24 |
| Comparative Example 4 | Toner 25 | ↑ | Two-component developer 25 |
| Comparative Example 5 | Toner 26 | ↑ | Two-component developer 26 |
| Comparative Example 6 | Toner 27 | ↑ | Two-component developer 27 |

Example 1

The resulting two-component developer 1 was evaluated in the following manner.

A modified imageRUNNER ADVANCE C9075 PRO (trade name), which is a digital commercial printer manufactured by Cannon Inc., was used as an image-forming apparatus. The two-component developer 1 was loaded into a developing device at a cyan position, and the DC voltage $V_{DC}$ of a developing sleeve, which is a developer bearing member, charging voltage $V_D$ of a photosensitive drum, and laser power were adjusted such as to obtain the desired carried amount of the toner on the photosensitive drum, which is an electrostatic latent image bearing member, or on the paper. The below-described evaluation was then performed. The modification involved changes such as to enable free setting of the fixation temperature and process speed.

The evaluation was performed on the basis of the following evaluation methods. The results are shown in Table 4.

<Evaluation 1>

(Charging Performance)

The triboelectric charging amount of the toner and the carrier amount of the toner were calculated by performing suction and collection of the toner on the photosensitive drum with a metal cylindrical tube and a cylindrical filter.

More specifically, the triboelectric charging amount of the toner and the carrier amount of the toner on the photosensitive drum were measured, for example, with a Faraday cage.

The Faraday cage, as referred to herein is a double wall coaxial tubular configuration in which the inner tube and outer tube are insulated from each other. Where a charging member with a charge amount Q is introduced into the inner tube, the electrostatic induction acts as if a metal cylinder with a charge amount Q is present. The induced charge amount was measured with an electrometer (KEITHLEY 6517A, manufactured by Keithley Instruments Inc.), and the ratio (Q/M) obtained by dividing the charge amount Q (mc) by the mass M (kg) of the toner in the inner tube was taken as the triboelectric charging amount of the toner.

The carried amount of the toner per unit surface area was determined by measuring the suction surface area S and dividing the mass M of the toner by the suction surface area S ($cm^2$).

The rotation of the photosensitive drum was stopped before the toner layer formed on the photosensitive drum was transferred to the intermediate transfer belt, which is an intermediate transfer member, and the toner image on the photosensitive drum was directly measured by air suction.

Carried amount of the toner ($mg/cm^2$)=M/S.

Triboelectric charging amount of the toner (mC/kg)=Q/M.

The carried amount of the toner on the photosensitive drum under a high-temperature and high-humidity environment (32.5° C., 80% RH) in the image-forming apparatus was adjusted to 0.35 $mg/cm^2$, and the toner was collected by suction with the metal cylindrical tube and cylindrical filter. In this case, the charge amount Q accumulated at the capacitor through the metal cylindrical tube and the mass M of the collected toner were measured and the charge amount Q/M (mC/kg) per unit mass was calculated and taken as the charge amount Q/M (mc/kg) per unit mass on the photosensitive drum (initial evaluation).

After the above-described evaluation (initial evaluation) has been performed, the developing device was taken off the apparatus and allowed to stay for 72 h under a high-temperature and high-humidity environment (32.5° C., 80% RH). The developing device was then again mounted on the apparatus, and the charge amount Q/M per unit mass on the photosensitive drum was measured at the DC voltage $V_{DC}$ in the same manner as in the initial evaluation (evaluation after storage).

The Q/M per unit mass on the photosensitive drum in the initial evaluation was taken as 100%, and the retention ratio [(evaluation after storage)/(initial evaluation)×100] of the charge amount Q/M per unit mass on the photosensitive drum after the 72-h storage (evaluation after storage) was calculated and estimated according to the following criteria.

(Evaluation criteria)

A: retention ratio is 80% or more: very good.

B: retention ratio is 70% or more and less than 80%: good.

C: retention ratio is 60% or more and less than 70%: acceptable level in the present invention.

D: retention ratio is less than 60%: unacceptable level in the present invention.

<Evaluation 2>

(Low-Temperature Fixability)

Paper: CS-680 (68.0 $g/m^2$)

(purchased from Canon Marketing Japan Inc.)

Carried amount of the toner: 1.20 $mg/cm^2$

Evaluated image: 10 $cm^2$ image arranged in the center of A4 paper sheet

Fixing test environment: low-temperature and low-humidity environment 15° C./10% RH (referred to hereinbelow as "L/L").

Process speed: 450 mm/sec

Fixation temperature: 130° C.

The low-temperature fixability of the fixed image output under the above-described conditions was evaluated by using the image-forming apparatus.

The evaluation of the low-temperature fixability was performed by using the value of the below-described image density decrease ratio as an indicator.

The image density decrease ratio was measured in the following manner. Initially, the density of the fixed image in the central portion was measured using an X-Rite color reflection densitometer (500 series, manufactured by X-Rite Inc.). Then, a load of 4.9 kPa (50 $g/cm^2$) was applied to the portion on which the fixed image density was measured, the fixed image was rubbed with a lens-cleaning paper (5 reciprocating cycles), and the fixed image density was measured again. The decrease ratio (%) of the fixed image density after the rubbing with respect to that before the rubbing was measured.

(Evaluation criteria)

A: density decrease ratio is less than 1.0% (excellent).

B: density decrease ratio is 1.0% or more and less than 5.0% (good).

C: density decrease ratio is 5.0% or more and less than 10.0% (acceptable level in the present invention).

D: density decrease ratio is 10.0% or more (unacceptable level in the present invention).

<Evaluation 3>

(Storability)

A total of 5 g of the toner was placed in a 100-mL plastic container and allowed to stay for 48 h in a thermostat with variable temperature and humidity (settings: 55° C., 41% RH). The cohesion of the toner particles after the storage was then evaluated.

The toner was sieved with a 20-1 μm mesh for 10 sec at 0.5-mm vibrations in POWDER TESTER PT-X manufactured by Hosokawa Micron Group and the residual ratios of the remaining toner were taken as evaluation criteria for the cohesion.

(Evaluation Criteria)

A: residual ratio is less than 2.0% (excellent).

B: residual ratio is 2.0% or more and less than 10.0% (good).

C: residual ratio is 10.0% or more and less than 15.0% (acceptable level in the present invention).

D: residual ratio is 15.0% or more (unacceptable level in the present invention).

<Evaluation 4>

(Anti-Hot Offset Property)

Paper: CS-680 (68.0 g/m$^2$) (purchased from Canon Marketing Japan Inc.)

Carried amount of the toner: 0.08 mg/cm$^2$

Evaluated image: 10 cm$^2$ image arranged in the center of A4 paper sheet

Fixing test environment: normal-temperature and low-humidity environment 23° C./5% RH (referred to hereinbelow as "N/L").

Process speed: 450 mm/sec

Fixation temperature: 210° C.

Ten plain postcards were fed to the central position of the fixing belt of the fixing unit of the image-forming apparatus, the fixed image was then output under the above-described conditions, and the value of fogging of the fixed image was taken as the evaluation criterion for the anti-hot offset property.

The average reflectance Dr (%) of the evaluation paper before the image reproduction and the reflectance Ds (%) of the white portion after the above-described fixation test were measured with a reflectometer ("REFLECTOMETER MODEL TC-6DS", manufactured by Tokyo Denshoku Co., Ltd.), and the fogging was calculated by the following formula. The resulting fogging was evaluated according to the criteria presented hereinbelow.

$$\text{Fogging}\ (\%) = Dr(\%) - Ds(\%)$$

(Evaluation criteria)

A: less than 0.2% (excellent).

B: 0.2% or more and less than 0.5% (good).

C: 0.5% or more and less than 1.0% (acceptable level in the present invention).

D: 1.0% or more (unacceptable level in the present invention).

Examples 2 to 21

The evaluation was performed in the same manner as in Example 1, except that the two-component developers 2 to 21 shown in Table 3 were used. The results are shown in Table 4.

Comparative Examples 1 to 6

The evaluation was performed in the same manner as in Example 1, except that the two-component developers 22 to 28 shown in Table 3 were used. The results are shown in Table 4.

TABLE 4

| | Charging ability Evaluation 1 | | | | Low-temperature fixability Evaluation 2 | | Storability Evaluation 3 | | Anti-hot offset property Evaluation 4 | |
|---|---|---|---|---|---|---|---|---|---|---|
| | | Q/M | | | | Density | | | | |
| | | Initial | after | Retention | | decrease | | Residual | | |
| Example No. | Evaluation | Q/M [mC/kg] | storage [mC/kg] | ratio [%] | Evaluation | ratio [%] | Evaluation | ratio [%] | Evaluation | Fogging [%] |
| Example 1 | A | 36.7 | 30.4 | 83 | A | 0.6 | A | 0.3 | A | 0.0 |
| Example 2 | A | 37.9 | 31.8 | 84 | B | 1.2 | A | 0.4 | A | 0.0 |
| Example 3 | A | 35.2 | 28.2 | 80 | A | 0.4 | B | 2.5 | A | 0.1 |
| Example 4 | A | 38.5 | 32.7 | 85 | B | 1.5 | A | 1.4 | A | 0.0 |
| Example 5 | B | 33.6 | 26.5 | 79 | A | 0.5 | B | 3.1 | B | 0.3 |
| Example 6 | B | 31.9 | 24.6 | 77 | A | 0.5 | B | 3.0 | B | 0.4 |
| Example 7 | A | 38.2 | 32.7 | 86 | B | 1.8 | A | 1.4 | A | 0.1 |
| Example 8 | B | 34.5 | 26.8 | 78 | B | 1.3 | A | 1.9 | B | 0.3 |
| Example 9 | A | 36.8 | 29.3 | 80 | B | 3.9 | A | 1.5 | B | 0.2 |
| Example 10 | A | 37.0 | 29.9 | 81 | B | 4.4 | A | 1.6 | B | 0.2 |
| Example 11 | B | 31.7 | 24.6 | 78 | B | 2.6 | B | 3.4 | B | 0.4 |
| Example 12 | B | 32.2 | 24.7 | 77 | B | 2.4 | B | 3.5 | B | 0.3 |
| Example 13 | B | 31.9 | 25.1 | 79 | B | 3.8 | B | 6.4 | B | 0.4 |
| Example 14 | B | 29.7 | 21.7 | 73 | B | 2.7 | B | 8.9 | B | 0.4 |
| Example 15 | B | 27.5 | 19.6 | 71 | B | 2.4 | B | 9.7 | B | 0.4 |
| Example 16 | C | 26.8 | 18.2 | 68 | B | 4.2 | C | 12.8 | C | 0.6 |
| Example 17 | C | 26.4 | 17.0 | 64 | B | 4.0 | C | 14.2 | C | 0.7 |
| Example 18 | B | 29.4 | 22.4 | 76 | C | 5.9 | B | 9.5 | B | 0.4 |
| Example 19 | C | 28.6 | 17.6 | 62 | B | 4.8 | C | 14.2 | C | 0.7 |
| Example 20 | C | 29.0 | 18.2 | 63 | C | 8.4 | C | 13.9 | C | 0.6 |
| Example 21 | C | 28.3 | 17.2 | 61 | C | 7.1 | C | 14.6 | C | 0.8 |
| Comparative Example 1 | D | 24.3 | 12.8 | 53 | C | 7.9 | D | 15.4 | C | 0.9 |
| Comparative Example 2 | C | 29.1 | 19.7 | 68 | D | 14.1 | C | 14.2 | C | 0.8 |
| Comparative Example 3 | D | 27.4 | 16.2 | 59 | D | 13.4 | D | 15.9 | D | 1.3 |
| Comparative Example 4 | D | 26.4 | 15.2 | 58 | C | 9.2 | D | 17.5 | D | 1.4 |
| Comparative Example 5 | D | 25.8 | 14.6 | 57 | C | 9.4 | D | 25.8 | D | 1.9 |
| Comparative Example 6 | C | 28.1 | 18.9 | 67 | D | 15.4 | C | 14.2 | C | 0.8 |

Comparative Example 1

In the toner 22 used in Comparative Example 1, the specific aliphatic compound is not used when synthesizing the crystalline polyester resin. Since the aliphatic compound is not included, the amount of low-molecular weight compound derived from the unreacted monomer in the crystalline polyester resin is large. As a result, the resin strength is low and durability is degraded, thereby degrading the storability and charging performance.

Comparative Example 2

The toner 23 used in Comparative Example 2 is obtained by adding 18.0 parts by mass of stearic acid (C18) as the aliphatic compound when synthesizing the crystalline polyester resin. Since the content ratio of the segment derived from the aliphatic compound is high, the plasticizing effect of the crystalline polyester resin is reduced. This is apparently why the low-temperature fixability of the toner has decreased.

Comparative Example 3

The toner 24 used in Comparative Example 3 is obtained by adding behenic acid (C22) as the aliphatic compound when synthesizing the crystalline polyester resin. Since the carbon number of the aliphatic compound is large, the plasticizing effect of the crystalline polyester resin is reduced. This is apparently why the low-temperature fixability of the toner has decreased.

Comparative Example 4

The toner 25 used in Comparative Example 4 is obtained by adding caproic acid (C6) as the aliphatic compound when synthesizing the crystalline polyester resin. Since the carbon number of the aliphatic compound is small, the amount of the low-molecular weight component in the crystalline polyester resin has increased. This is apparently why the storability and anti-hot offset property have decreased.

Comparative Example 5

The crystalline polyester resin contained in the toner particle of the toner 26 used in Comparative Example 5 has a low weight-average molecular weight (Mw) of 4100. Since the weight-average molecular weight of the crystalline polyester resin is low, the amount of the low-molecular weight component derived from the unreacted monomer in the crystalline polyester resin is large. As a result, the resin has a low strength and decreased durability. This is apparently why the storability and charging performance have decreased.

Comparative Example 6

The crystalline polyester resin contained in the toner particle of the toner 27 used in Comparative Example 6 has a high weight-average molecular weight (Mw) of 15,600 and does not include the specific aliphatic compound.

Since the crystalline polyester resin has a high weight-average molecular weight despite the absence of the aliphatic compound, the amount of the low-molecular weight component derived from the unreacted monomer is comparatively small. Therefore, the storability, anti-hot offset property, and charging performance are improved over those of the toner 26 of Comparative Example 5, but since compatibility with the amorphous polyester resin is low, the low-temperature fixability has decreased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-098583, filed May 13, 2015, and Japanese Patent Application No. 2016-084737, filed Apr. 20, 2016, which are hereby incorporated by reference herein in their entirety.

What is claimed is:

1. A toner comprising a toner particle, said toner particle comprising an amorphous polyester resin, a crystalline polyester resin, wax, and a colorant, wherein the crystalline polyester resin is a polycondensate of a 1,6-hexanediol, dodecanedioic acid, and a stearic acid, the crystalline polyester resin contains 0.5 to 15.0 mass % of a segment derived from the stearic acid, said segment being represented by $C_{17}H_{35}CO$— at the end of the crystalline polyester resin, and at most 5 mass % of components have a number average molecular weight of 1000 or less in a molecular weight distribution of chloroform soluble matter of the crystalline polyester resin measured by gel permeation chromatography.

2. The toner according to claim 1, wherein the weight-average molecular weight (Mw) of the crystalline polyester resin is 8000 to 12,000.

3. The toner according to claim 1, wherein the content of the crystalline polyester resin is from 0.5 part by mass to 15.0 parts by mass per 100 parts by mass of the amorphous polyester resin.

4. The toner according to claim 1, wherein at most 4 mass % of components have a number average molecular weight of 1000 or less in said molecular weight distribution of chloroform soluble matter of the crystalline polyester resin measured by gel permeation chromatography.

* * * * *